United States Patent [19]

Dominguez

[11] 4,114,186

[45] Sep. 12, 1978

[54] LIGHTING FIXTURE

[76] Inventor: Richard Lee Dominguez, 3835 W. Eva Ave., Phoenix, Ariz. 85021

[21] Appl. No.: 800,634

[22] Filed: May 26, 1977

[51] Int. Cl.[2] ..... F21V 21/30

[52] U.S. Cl. ..... 362/35; 362/150; 52/28

[58] Field of Search ..... 362/20, 35, 147, 148, 362/150, 254; 52/28; 250/203 R; 350/6

[56] References Cited

U.S. PATENT DOCUMENTS

| | | | |
|---|---|---|---|
| 1,652,347 | 12/1927 | Champeau | 362/147 X |
| 3,113,728 | 12/1963 | Boyd | 362/147 X |
| 3,130,922 | 4/1964 | Smith | 362/148 |
| 3,403,614 | 10/1968 | Garnes | 362/147 X |
| 3,755,667 | 8/1973 | Price | 52/28 X |
| 3,855,463 | 12/1974 | Fowler | 52/28 X |
| 4,041,307 | 8/1977 | Napoli et al. | 250/203 R |

*Primary Examiner*—Peter A. Nelson

*Attorney, Agent, or Firm*—Cahill, Sutton & Thomas

[57] ABSTRACT

A hollow light duct extends through the roof of a building to the ceiling of a room within the building to be lighted. A translucent light emitting panel is mounted over one end of the duct on the roof of the building and a hingeable lid is secured to the end of the duct. The lid is provided with a reflecting surface for reflecting sunlight through the translucent panel into the duct. The opposite end of the duct includes a diffusing panel positioned in the ceiling of the room; the duct includes artificial light source to provide illumination when insufficient daylight is present; the reflecting lid is closed to reflect the artificial light and prevent its escape from a duct when the artificial light source is in use.

11 Claims, 4 Drawing Figures

LIGHTING FIXTURE

The present invention pertains to light fixtures, and more particularly, to light fixtures utilizing daylight as a source of illumination for a room within a building.

Energy consumed by lighting fixtures on days where ample sunlight is available is essentially wasted. Innumerable proposals have been made in the prior art for admitting sunlight into rooms within a building, including the utilization of sky-lights. Ordinary skylights incorporate a simple opening in the roof covered by a translucent panel that admits daylight into the area below; some more advanced types of skylights incorporate a dead air space between two such panels in an attempt to control the heat loss or gain through the panels. The light admitted through such panels or skylights obviously varies radically depending on the time of day and also upon the time of year. Characteristically, such skylights are simply horizontally positioned in the roof and no attempt is made to gather additional light from the sun for the building below. Some prior art techniques such as U.S. Pat. No. 668,404 and U.S. Pat. No. 2,022,144 have suggested the utilization of reflecting panels for increasing the utility of a skylight by redirecting sunlight or the inclusion of means for following the sun; however, the prior art devices have tended to become complicated and inefficient.

When insufficient daylight exists, to provide the necessary interior illumination, auxiliary lighting systems are required in buildings using skylights, see for example U.S. Pat. No. 1,245,520. The skylights permit light to escape from the interior of the building in a manner identical to that with which light had entered the building during the day. Further, heat loss in the winter and heat gain in the summer has generally militated against the use of such skylight devices.

It is therefore an object of the present invention to provide a lighting fixture for lighting the interior of a building through the combined utilization of sunlight and artificial light.

It is another object of the present invention to provide a lighting fixture that utilizes sunlight as a light source but may nevertheless efficiently utilize artificial light during time periods when insufficient daylight is present.

It is another object of the present invention to provide a lighting fixture utilizing both daylight and artificial light and which provides heat insulation to prevent heat transfer through the fixture.

It is still another object of the present invention to provide a lighting fixture utilizing both daylight and artificial light and which permits the optimum, efficient use of both sources of light.

These and other objects of the present invention will become apparent to those skilled in the art as the description thereof proceeds.

Briefly, in accordance with one embodiment chosen for illustration, a hollow light duct extends through the roof of a building into the interior thereof and terminates at the ceiling of a room to be lighted. The duct is covered on the outside by a translucent light admitting panel which may be mounted at a slight angle with respect to the plane of the roof to permit water to readily drain therefrom and to permit more sunlight to enter during winter months. A lid, which is opaque, is hingedly secured to the duct adjacent the light admitting panel and is provided with a reflective surface for redirecting daylight onto the light emitting panel. The lower end of the duct is enclosed with a light diffusing panel which may form a part of, or be positioned above or adjacent, the ceiling of the room to be lighted. An artificial light source, such as a fluorescent lamp, is mounted within the duct and is positioned beneath two heat insulating glass panels; the duct is formed of two sections which telescopically engage one another and are secured respectively to the roof and the ceiling. The reflective surface on the lid redirects daylight through the ducts into the room below; when artificial light is to be utilized as the source of light, the lid is closed and acts as a reflector to insure that substantially all of the light generated by the artificial light source is directed into the room and does not escape outwardly of the duct.

The present invention may more readily be understood by reference to the accompanying drawings in which.

Figure 1:
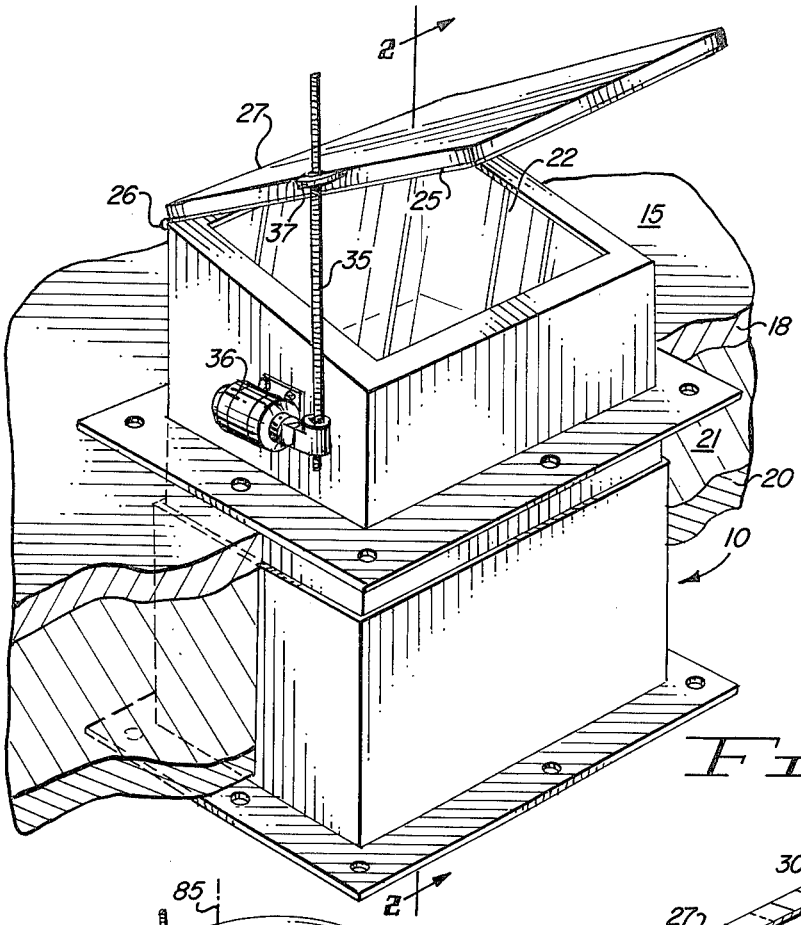
FIG. 1 is a perspective view of a lighting fixture constructed in accordance with the teachings of the present invention and showing the fixture positioned on the roof of a building.
Figure 2:
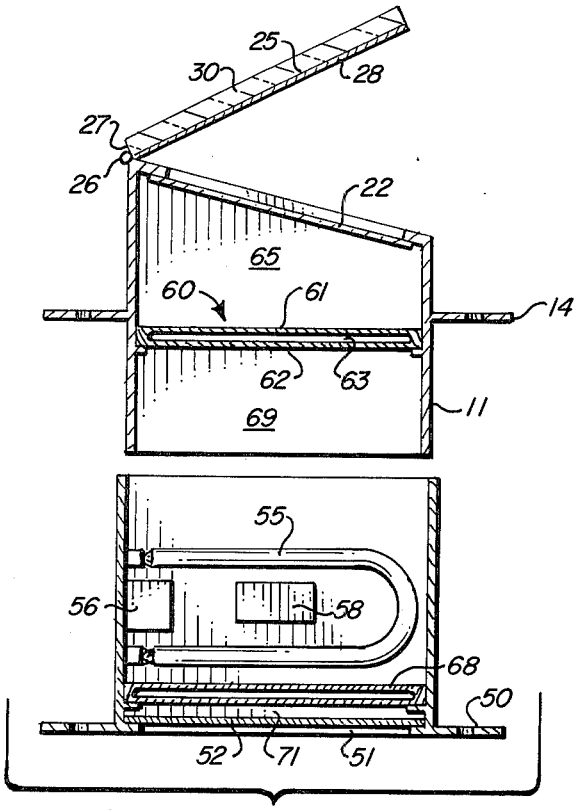
FIG. 2 is a cross-sectional view of FIG. 1 taken along lines 2—2.

Referring now to FIGS. 1 and 2, the lighting fixture of the present invention is shown having a hollow light duct 10 formed of two telescoping halves 11 and 12. The upper half 11 incorporates a flange 14 which may be secured to a roof such as that shown at 15 in FIG. 1. The roof 15 is schematically shown having a conventional roofing surface 18 positioned above the ceiling 20 of a room located below. The space 21 intermediate the roof surface 18 and ceiling 20 is conventionally formed in single story commercial buildings by steel or wood joists having insulation therein and possibly providing additional ventilating space above the insulation. The present invention is primarily directed to single story buildings having a roof that can support a structure such as that shown in FIG. 1 wherein the room to be lighted is directly below the roof. It will be understood that the lighting fixture of the present invention may have applicability to other structures; however, the efficiency of the unit will drastically be reduced if the distance between the roof of the building and the ceiling of the room to be illuminated becomes greater than approximately twelve feet.

The duct 10 extends upwardly through the roof and is secured by the flange 14 to the upper surface 18 of the roof 15; conventional sealing techniques can be used to seal the flange 14 to the roof to prevent water leakage. The upper end of the duct 10 terminates with a translucent light admitting panel 22 which may be constructed of suitable conventional plastic material such as acrylic or polycarbonate. Such material is readily available on the market and is generally white and infra-red reflecting translucent to readily admit daylight therethrough while simultaneously diffusing the light over the surface of the panel and preventing glare and to also reflect heat-generating infra-red. A clear panel 22 could also be used; however, a diffusing panel would be needed. As used herein, reference to a translucent light admitting panel is intended to include clear panels with supplemental diffusing panels associated therewith to transmit and diffuse light. An opaque lid 25 is hinged at 26 along one side 27 thereof to the upper portion of the duct 10. The bottom side 28 of the lid is reflectively coated to reflect daylight therefrom downwardly through the translucent panel 22 into the duct 10. The reflective coating may be formed in any conventional manner and may be formed of an aluminized surface with an unbreakable plastic coating. A rubberized coating 30 is provided on the top of the lid 25 to protect the lid from damage during weather disturbances, such as hail storms, and to also provide sound insulation to limit the noise caused by hail striking the light fixture.

Figure 3:
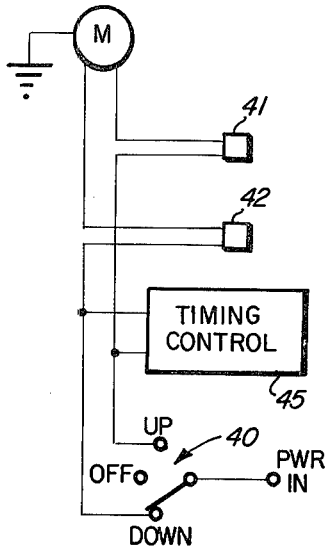
FIG. 3 is a simplified schematic block diagram of an electrical circuit suitable for use with the invention of FIG. 1.

The lid 25 is hingeable and may be "opened" or "closed" by pivoting the lid about the hinge 26. The lid is hinged so that it may open to a position somewhat less than vertical and closed completely against the top of the duct 10. The hinged lid 25 together with its reflective surface 28 provides several advantages. Depending on the latitude of the building utilizing the lighting fixture of the present invention, the lid 25 may be elevated to obtain maximum light from outside; however, in certain areas of the country, particularly high sunshine areas such as the Southwest, the hinged lid may actually be utilized to somewhat shade the translucent panel 22 to prevent the transmission of too much light which might otherwise cause the interior of the room to be uncomfortably bright. The hinged lid may be raised and lowered by innumerable conventional means; however, in the embodiment chosen for illustration, a threaded actuation rod 35 is shown that is rotated by an electric motor 36 mounted on the side of the duct 10. The actuation rod threadedly engages an extension 37 provided on the lid 25. The electric motor is reversible and may turn the actuation rod to open or close the lid 25. The actuation of the motor 36 may be either manual or automatic. For example, referring to FIG. 3, a manual actuation system is shown incorporating a simple two-way switch 40 that is operated within the room in which the lighting fixture is positioned to permit an individual to open or close the lid 25, or to position the lid in any desired manner. Limit switches 41 and 42 are provided to limit the energization of the motor and prevent damage to the lid by permitting it to be driven beyond predetermined maximum opening and closed positions. A timing control 45 is shown which may be formed of a simple electrical clock mechanism readily available on the market for opening and closing an electric circuit. The timing control may be set to open the lid 25 during daylight hours and close the lid after dark. The daylight hours will obviously change throughout the year and the timing control can be set in accordance with the seasons. The control 45 may alternatively be a photo cell that triggers the closing of the lid 25 when insufficient daylight is available.

The lower portion 12 of the duct 10 incorporates a flange 50 which may be positioned flush with, below, or immediately above the ceiling 20. It will be obvious to those skilled in the construction arts that the flange 50 may take a variety of forms to provide a pleasing architectural appearance and blend with the ceiling with which it is used. The lower opening 51 of the duct 10 is provided with a light defusing panel 52 of conventional design and presently available in both plastic and glass forms. The lower portion 12 of the duct 10 is provided with artificial light source 55 which, in the embodiment chosen for illustration, is formed of a conventional U-shaped 40 watt fluorescent lamp having appropriate ballast and transformer circuitry shown schematically at 56. While the embodiment chosen for illustration incorporates a single 40 watt fluorescent lamp, it will be obvious to those skilled in the art that two or more such lamps, or lamps of higher ratings may be incorporated depending on the illumination required of the light fixture. An opening 58 is provided in the duct 10 for purposes to be described more fully hereinafter.

The upper and lower portions of the duct 10 are telescoped together from opposite sides of the roof and ceiling respectively as shown in FIG. 1. The flanges 14 and 15 are secured and the duct becomes substantially a one-piece duct having a generally rectangular cross-section. The interior surfaces of the duct are formed of white gloss plastic coating or enamel to provide a highly reflective and efficient light transmitting duct. Alternatively, the surfaces may be illuminized and provided with a mirror-like reflecting surface to increase the efficiency of transmission; however, it is believed that a white surface is sufficiently efficient and economically advisable for most installations. The duct 10 is provided with two "double pane" heat barriers to provide heat insulation and to thermally isolate the room being illuminated from the exterior of the building. The first double pane heat barrier 60 forms a light transmitting, heat insulating device having parallel light transmitting panels 61 and 62 separated by a small air space 63. In the embodiment chosen for illustration, the double pane device 60 is provided with an evacuated air space 63 to minimize heat conduction therethrough. The double pane device 60 may also be formed of separate sheets of glass or plastic material that are merely separated by a spacer around the peripheral edges thereof and assembled within the duct without an evacuated space therebetween. The double pane device 60 is positioned slightly below the flange 14 so as to heat insulate the space 65 within the duct 10 above the roof 15 from that portion of the duct below the roof. A second double pane device 68 is positioned at the opposite end of the duct 10 slightly above the ceiling 20 and below the artificial light source 55. The double pane device 68 may be constructed in a manner identical to that of the device 60. It will be noted that the double pane devices 60 and 68 are positioned to effectively isolate and insulate the space 65 of the duct above the roof from the space 69 of the duct 10 between the roof and ceiling and the space below the ceiling in the room to be illuminated. Thus, on days in which the interior of the building is being refrigerated, the hot air existing in the space 65 is thermally insulated from the space 69 beneath the roof; further, when the lid 25 is closed and the auxiliary light source 55 is being used, the heat generated by the light source 55 is insulated from the room being illuminated.

The opening 58 in the lower portion 12 of the duct 10 is provided to permit the flow of ventilation air into the unit to prevent the space 69 from becoming too hot in the event the artificial light source 55 is extensively used and generates substantial heat. It may be noted that the dual pane device 68 may be placed sufficiently close to the light diffusing panel 52 so that an additional dead air space is formed at 71 to provide additional insulation; alternatively, the dual pane device 68 may be provided with a diffusing lower pane such that it may be utilized to provide the dual functions of both a heat insulator as well as a diffusing panel to thereby eliminate the necessity of the panel 52. The artificial light source 55 may be formed into a globe or pancake shape to essentially extend entirely across the duct 10 and may thus act as both a light source and a heat transmission barrier; the lower surface of any such light source may act as a diffusing panel to thereby eliminate the need of panel 52 as well as device 68.

Figure 4:
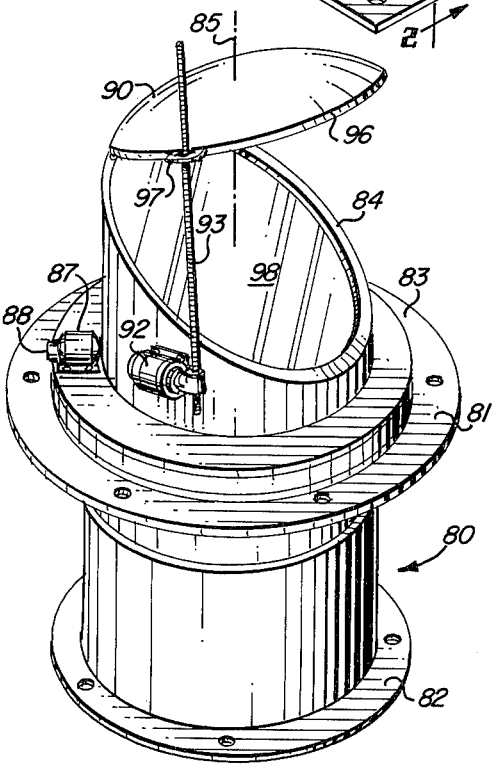
FIG. 4 is a perspective view of another embodiment of the present invention.

Referring now to FIG. 4, another embodiment of the lighting fixture of the present invention is shown. The light duct 80 in the embodiment of FIG. 4 is circular in cross-section forming a telescoping cylindrical duct having flanges 81 and 82 for securing in a manner described in connection with the embodiment shown in FIG. 1. A rotatable bearing mount 83 permits rotation of the top portion 84 of the duct. Thus, the portion 84 may rotate about its longitudinal axis 85 while an electric motor 87 drives a small drivewheel 88 that frictionally engages the flange 81 to rotate the upper portion 84 with respect to the flange 81 and the remainder of the duct.

A lid 90 is hingeably secured to the upper portion 84 and is positionable through the utilization of an electric motor 92 driving actuating rod 93 threadedly engaging in extension 94 on the lid 90. The lid 90 contains a reflecting surface 96 for redirecting sunlight onto the translucent panel 98. The interior of the duct 80 incorporates the same structures and features described in connection with the embodiments of FIGS. 1 and 2; however, the double pane devices and diffusing panel will, of course, be circular rather than rectangular. Further, the artificial light source for use in the embodiment of FIG. 4 may conveniently be a commercially available toroidal shaped fluorescent light fixture which extends about the internal periphery of the circular cross-section of the duct 80.

The positioning of the lid 90 may occur in a manner identical to that described in connection with the embodiment of FIGS. 1 and 2; however, the motor 87 may be energized to rotate the top portion 84 (and therefore the reflecting surface 96) to "follow the sun" in a manner conventional with certain solar collector and solar testing devices. Thus, the electric motor can simply be a clock motor that will rotate the upper portion 84 of the light fixture of FIG. 4 so that the reflecting surface 96 points in the direction of the sun during daylight hours to greatly extend the time period throughout which the lighting fixture of the present invention may be used; that is, adequate light may be derived from early morning through evening. The reflector may be returned to its beginning or morning position in the morning through the use of a limit switch which simply returns the angular position of the upper portion 84 to its beginning position and stops until the timing control (such as that shown at 45 in FIG. 3) reopens the lid 90 and the timing motor 87 is energized to continuously aim the reflecting surface 96 toward the sun throughout the following day.

The operation of the device of the present invention may be described as follows. Assuming the utilization of the embodiment shown in FIGS. 1 and 2, the upper and lower portions, 11 and 12 respectively, of the light duct 10 are positioned through a hole provided therefor in the roof and ceiling of the building and room to be illuminated. The respective flanges 14 and 15 are appropriately secured to the roof and ceiling to provide a continuous rectangular cross-section duct 10 to receive and transmit light into the room below. The lid 25 is positioned, either manually or remotely and electrically, to provide the desired reflecting characteristic of the daylight or sunlight onto the translucent light admitting panel 22. Light thus travels through the interior of the duct 10 (the transmission efficiency of which is enhanced through the utilization of highly reflecting surfaces) through the light transmitting, heat insulating dual pane devices 60 and 68, through the diffusing panel 52 into the room below. The positioning of the lid 25 and the reflective surface 28 is established to provide the desired level of light within the room. In certain areas of the country, it may be desirable to partially close the lid 25 and to thereby partially shade the panel 22 to prevent over-illumination within the room. In the event of an extremely cloudy day or a rainstorm, the panel 25 is moved to its closed position wherein the reflective surface 28 provides a reflective surface for the light emanating from an artificial light source 55. The efficiency of the light fixture is therefore maintained and none of the light emanating from the artificial light source 55 is permitted to escape out of the building. The rubberized surface 30 prevents the annoying noise and "drumming" effect of rain and hail on the light fixture. Heat transmission in inhibited through the duct by the devices 60 and 68 while the heat generated by the artificial light source 55 is permitted to escape through openings 58 in the duct into the attic or ceiling-to-roof space of the building.

It will be obvious to those skilled in the art that many modifications can be made in the present invention without departing from the spirit and scope thereof. For example, the specific dimensions of the device being utilized will depend in a great extent upon the distance between the roof and the ceiling of the room to be illuminated as well as the amount of light desired. Similarly, the types of artificial light sources utilized within the fixtures will also depend on the illumination required, the size of the fixture, and the distance between the fixture, the reflecting surface of the closed lid, and the diffusing panel through which light emanates into the illuminated room.

I claim:

1. A lighting fixture for use in the ceiling of a room in a building to be lighted, said building having a roof, comprising:

(a) means defining a hollow light duct extending from the roof of said building to the ceiling of the room to be lighted;

(b) a light admitting panel mounted at one end of said light duct on the roof of said building;

(c) an opaque lid hingeably secured to said light duct adjacent said light admitting panel, said lid having a light reflecting surface to direct daylight through said light admitting panel into said duct; said light reflecting surface of said lid being positionable from nearly vertical to a closed position covering said light admitting panel when artificial light is to be used;

(d) a light diffusing panel enclosing said duct at the ceiling of said room;

(e) light transmitting, heat insulating means mounted in said duct below the level of said roof; and (f) an artificial light source, mounted in said duct, for generating light when said daylight is insufficient to provide the desired light level in said room, light from said artificial source being transmitted through said light diffusing panel and being reflected from said reflecting surface through said light diffusing panel.

2. The lighting fixture of claim 1 wherein said light duct extends upwardly through said roof and terminates above said roof and includes a flange for securing said duct to said roof.

3. The lighting fixture of claim 1 wherein said duct includes first and second telescopic sections to accommodate varying distances between said roof and said ceiling.

4. The lighting fixture of claim 1 including a second light transmitting, heat insulating means mounted in said duct and positioned above said ceiling but below said artificial light source.

5. The lighting fixture of claim 1 including means for automatically positioning said lid to open and close said lid in accordance with the time of day.

6. The lighting fixture of claim 1 wherein at least a portion of said duct is rotatable about a vertical axis and includes means for rotating said portion about said axis to permit said reflecting surface to follow the sun during the day.

7. The lighting fixture of claim 1 wherein said light transmitting, heat insulating means comprises dual transparent panes.

8. The lighting fixture of claim 1 wherein said light transmitting, heat insulating means comprises dual glass panes having an evacuated space therebetween.

9. The lighting fixture of claim 1 wherein said duct terminates at the upper end thereof at an angle with respect to the plane of the roof to facilitate drainage and to increase light admitted to said duct during winter.

10. The lighting fixture of claim 1 wherein said artificial light source and said light transmitting, heat insulating means are one and the same.

11. The lighting fixture of claim 4 including means defining an opening in the side of said duct to provide air communication between said duct and the space between said roof and ceiling.

* * * * *